United States Patent [19]

Fox

[11] Patent Number: 5,012,732

[45] Date of Patent: May 7, 1991

[54] TRASH COMPACTOR FOR SANITARY HANDLING OF SOLID WASTE

[75] Inventor: Anthony Fox, Bloomington, Minn.

[73] Assignee: Marcella M. Fox, Bloomington, Minn.

[21] Appl. No.: 529,661

[22] Filed: May 29, 1990

Related U.S. Application Data

[62] Division of Ser. No. 357,206, May 26, 1989, Pat. No. 4,944,220

[51] Int. Cl.[5] ..... B30B 13/00

[52] U.S. Cl. ..... 100/35; 100/90; 100/229 A

[58] Field of Search ..... 100/35, 41, 90, 229 A, 100/255

[56] References Cited

U.S. PATENT DOCUMENTS

| | | | |
|---|---|---|---|
| 3,424,078 | 1/1969 | Boyd et al. | 100/229 A X |
| 3,583,312 | 6/1971 | Van Doorn et al. | 100/90 |
| 3,589,276 | 6/1971 | Swallert | 100/90 |
| 3,881,408 | 5/1975 | Valor | 100/90 X |
| 4,008,658 | 2/1977 | Stock et al. | 100/229 A X |
| 4,152,035 | 5/1979 | Fox | 100/229 A X |
| 4,273,037 | 6/1981 | Ruebesam | 100/229 A X |
| 4,524,048 | 6/1985 | Schmidt et al. | 100/90 X |

*Primary Examiner*—Harvey C. Hornsby
*Assistant Examiner*—Stephen F. Gerrity
*Attorney, Agent, or Firm*—Haugen and Nikolai

[57] ABSTRACT

A trash compactor of the type comprising a hollow cabinet containing a reciprocally movable compaction plate for crushing and reducing the volume of waste materials deposited therein also includes a sanitary air filtration system for inhibiting the release or airborne particles beyond the confines of the cabinet. A removable air plenum assembly is mounted within the cabinet and has an air inlet in fluid communication with the interior of the compactor cabinet and an air discharge. Motor driven fans create a negative pressure within the cabinet and a series of in-line filters are disposed in the air flow path for capturing airborne particles greater than about 0.3 microns in size and for deodorizing the air exiting the system. The motor-driven fans operate continuously at a low speed when the doors of the trash compactor cabinet are closed and switched to a higher speed when the doors are open to thereby inhibit any outward distribution of airborne particles except through the filter.

2 Claims, 2 Drawing Sheets

TRASH COMPACTOR FOR SANITARY HANDLING OF SOLID WASTE

This is a Divisional of copending application Ser. No. 07/357,206, filed on May 26, 1989, now U.S. Pat. No. 4,944,220.

BACKGROUND OF THE INVENTION

I. Field of the Invention

This invention relates generally to solid waste disposal apparatus and more particularly to a trash compacting machine especially designed for use in buildings where highly sanitary conditions must be maintained.

II. Discussion of the Prior Art

The TFC Corporation of Minneapolis, Minn., applicant's assignee, has been engaged for a number of years in the manufacture and sale of trash compacting equipment designed primarily for commercial and industrial use. These compactors generally comprise a hollow, rectangular cabinet (a rectangular parallelepiped) having a top, a base, three mutually perpendicular walls and an opened front to which one or more doors are hinged for rotation about a vertical axis aligned with the forward edge of one of the side walls. The cabinet can be considered as being functionally partitioned into three vertically aligned chambers including an upper machine compartment, an intermediate trash receiving compartment and a lower compaction compartment. Disposed in the machine compartment is a compaction plate which is adapted to be driven reciprocally by a drive mechanism so as to pass through the trash receiving compartment into the compaction compartment. The drive mechanism may typically comprise an electric motor driving a hydraulic pump whose output is coupled to a hydraulic ram. The compaction plate is then joined to the lower end of the piston rod of the ram.

When used, the solid waste to be compacted is dumped through a door and chute into the trash receiving compartment and it falls into the compaction chamber. At appropriate times, an operator may cycle the compactor to cause the compaction plate to descend and crush and compact the loose trash into a small volume. While interlocks are provided to insure that, for safety reasons, the door covering the compaction chamber is closed when the compaction plate is in motion, because the doors are not sealed with a suitable perimeter gasket, there is a tendency for air to be forced out through the door/cabinet interface. This release of air, possibly contaminated with undesirable airborne particles, cannot be tolerated in certain applications or environments. For example, in a hospital environment, the trash being disposed of may be contaminated with bacteria and harmful germs. Similarly, in restaurants and hotels, etc., where the trash compacting equipment is located proximate a kitchen area, health codes may dictate a safer, cleaner disposal operation.

SUMMARY OF THE INVENTION

In accordance with the present invention, means are provided for assuring that air squeezed out of the loose trash during the compaction operation does not find its way out through the door/cabinet interface, but instead, is made to flow through a filter assembly where airborne particles greater than a certain number of microns are captured. Specifically, the filtration unit is designed to fit within the machinery cabinet and includes an air plenum having an air inlet in fluid communication with the interior of the compactor compartment and a discharge port which may be coupled through appropriate conduit to a building vent. Electrical motor-driven fans are positioned in the plenum to create a negative pressure within the cabinet so that air is continuously drawn in through the interface between the door and cabinet body with that air also being drawn through a multi-stage filtering system before being released into the vent.

In further accordance with the present invention, a two-speed fan motor is utilized so that when the compactor doors are closed, it operates at a lower speed and, hence, is more quiet in operation. When the trash loading door or the bale removing door are opened, the fan speed switches to high to create an increased draft, drawing outside air in and ultimately through the filtering system. In this fashion, bacteria, germs and odors are effectively removed from the air stream and contaminated air is inhibited from being released into the environment surrounding the compaction equipment. Moreover, the compactor incorporating the present invention may include an ozone lamp suitably positioned to produce natural ozone within the compactor cabinet for destroying germs and odor-causing bacteria.

DESCRIPTION OF THE DRAWINGS

The foregoing features and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
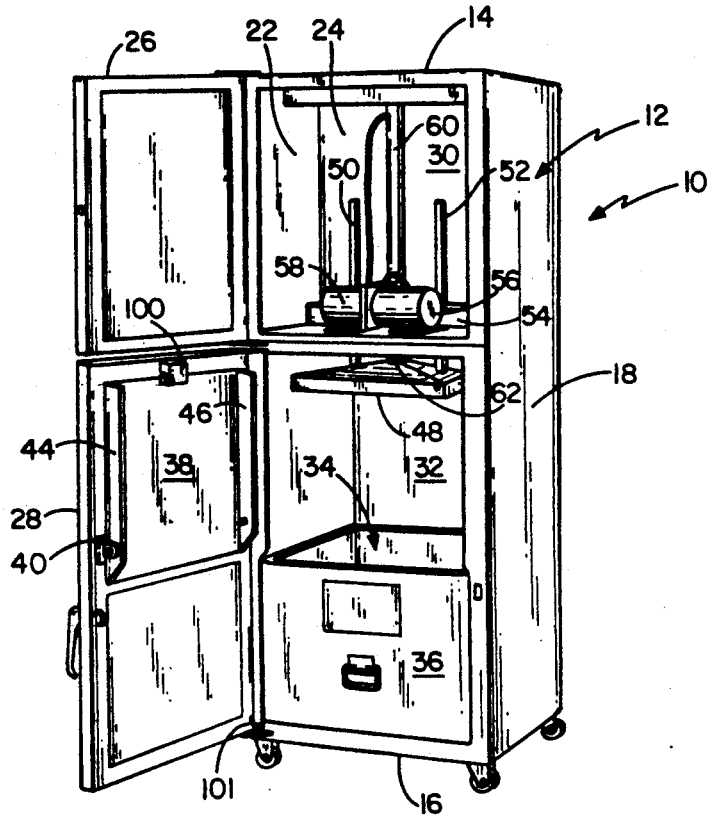
FIG. 1 is a perspective view of a trash compactor in accordance with the present invention.

Referring to FIG. 1, there is indicated generally by numeral 10 a trash compactor incorporating the air handling/filtration system of the present invention. The compactor 10 is seen to comprise a refrigerator-style cabinet 12 having the form of a rectangular parallelepiped with a top 14, a bottom or base 16 and three mutually perpendicular side walls 18, 20 and 22 defining a generally open front 24. Hinged for rotation about the front edge of the side panel 22 is an upper door 26 and a lower door 28.

The interior of the cabinet 12 may be considered as being divided into three functional chambers or compartments. The uppermost compartment 30 may conveniently be referred to as the machinery compartment, while the intermediate compartment 32 may be referred to as the trash receiving compartment. Immediately below the trash receiving compartment 32 is the compaction compartment 34. In the view of FIG. 1, there can be seen located in the compaction compartment 34 a trash bale receiving box 36.

Figure 2:
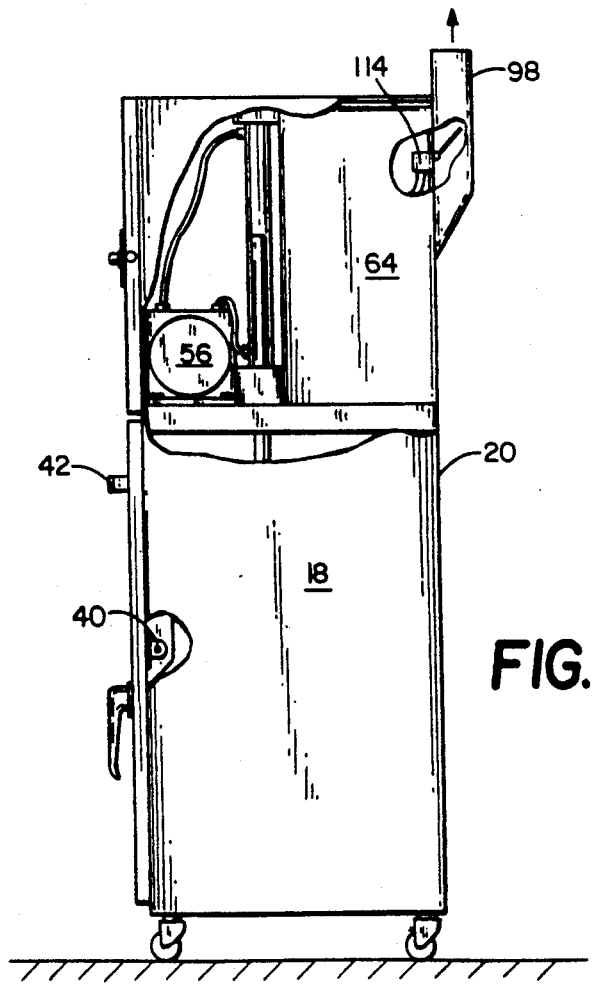
FIG. 2 is a side view, partially cut-away, showing the air collection/filtering apparatus.

With reference again to the lower door 28, it itself includes a second door panel 38 which is hinged along a horizontal axis as at 40 (FIG. 2). When the handle 42 is grasped and pulled outward, it withdraws a spring-loaded release latch (not shown) so that the door panel 38 can be pulled out to allow loose trash to be dumped through the opening into the box 36. The interior of the door panel 38 is preferably provided with side walls 44 and 46 which together form a chute to facilitate the loading operation.

The compactor further includes a compaction plate 48. The compaction plate 48 is provided with two parallel, spaced-apart guide rods 50 and 52 which pass through sleeve bearings (not shown) in a cross-frame member 54 located in the machine compartment 24. For driving the compaction plate in reciprocal fashion, the drive means may comprise an electric motor 56 coupled in driving relation to a hydraulic pump 58 to provide fluid under pressure to a hydraulic ram 60. The compaction plate 48, itself is fastened to the lower end of the piston rod 62 of the hydraulic ram. Control means, not relevant to the present invention, are also included for controlling the selective upward and downward movement of the compaction plate by the hydraulic ram.

Figure 3:
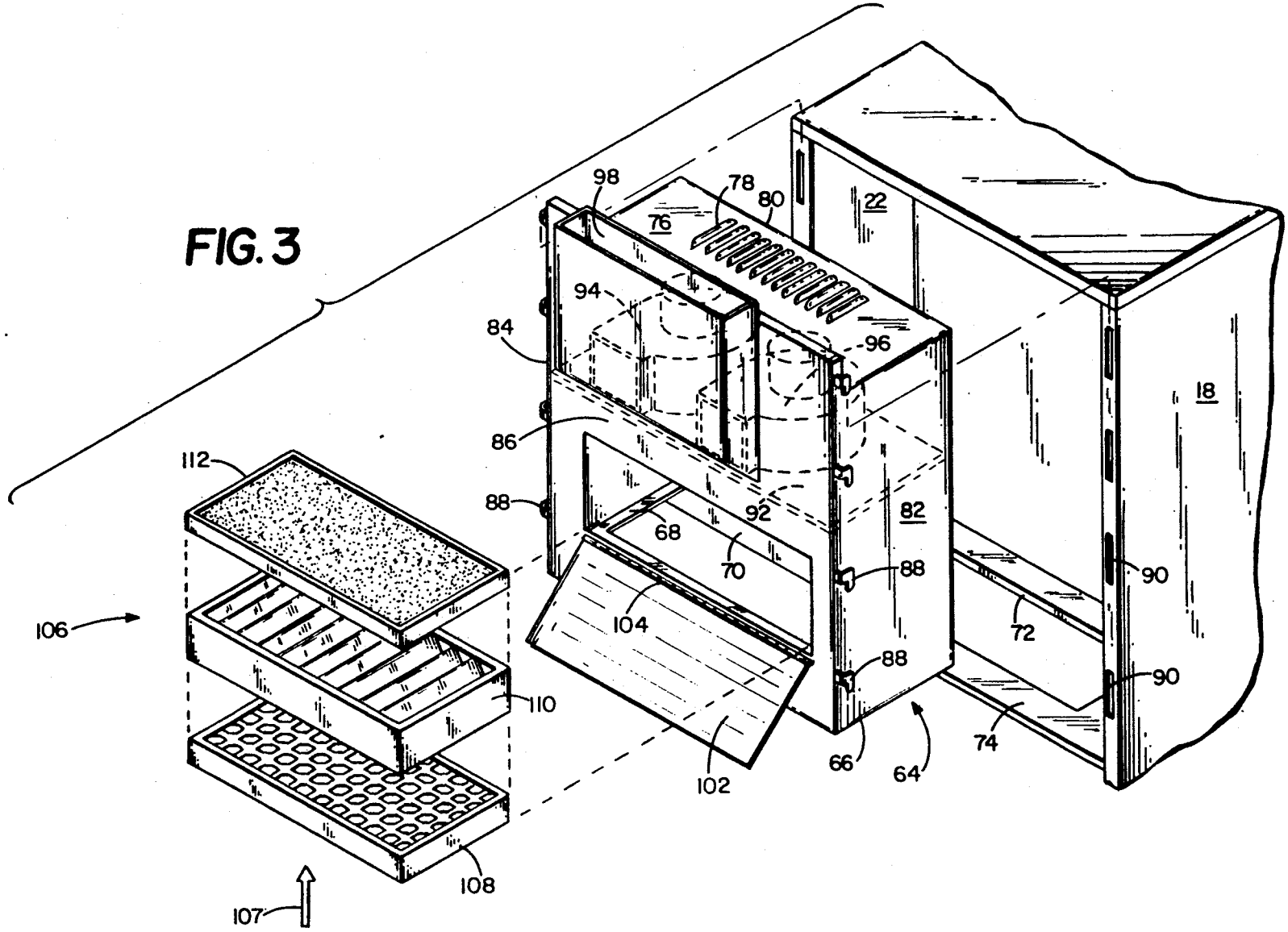
FIG. 3 is a partial, perspective, blown-apart view taken from the rear of the cabinet of FIG. 1.

Referring next to FIGS. 2 and 3, it can be seen that there is also located in the machine compartment 24 a box-like enclosure 64 which is referred to herein as an air plenum. More specifically, it includes a bottom wall 66 having a rectangular opening 68 cut therein forming an air inlet. Surrounding the air inlet 68 are downwardly depending flanges as at 70 which are dimensioned to fit within a rectangular opening 72 formed in the floor 74 of the machinery compartment 30. The air plenum 64 also includes a top plate 76 having louvers 78 formed therethrough, a front panel 80, two opposed side panels 82 and 84 and a rear panel 86.

Formed along the side edges of the rear panel 86 are a series of spaced-apart tabs as at 88 which are intended to mate with corresponding slots as at 90 formed on the rear side edges of the side panels 18 and 22 of the compactor cabinet. Thus, by inserting the air plenum box 64 into the rear of the machine cabinet until the tabs 88 enter slots 90 and then allowing the air plenum to drop only a fraction of an inch, the air plenum assembly is installed as a subassembly of the trash compactor itself.

With continued reference to FIG. 3, it will be observed that a sheet metal shelf 92 extends horizontally and parallel to the top 76 and bottom 66. Mounted atop the shelf 92 and aligned with circular openings (not shown) formed through the shelf are first and second electric motor-driven squirrel-cage fans 94 and 96. The fan exhaust outlets, in turn, pass through openings provided in the rear panel 86. An exhaust duct 98 of rectangular cross-section is attached to the rear panel 86 in covering relation to the fan exhaust ports to thereby direct the air flow upward. While not shown, a suitable adapter and ducting can be used to vent to the outside.

The motors associated with the squirrel-cage fans are of a two-speed variety. Door control switches 100 and 101 in FIG. 1 are coupled by conductors (not shown) to the fan motors whereby when the doors 26 and 28 are each closed, the door switches will cause the motors to operate at their lowermost speed. When either of the doors 26 or 28 is opened, the fan motors operate at their maximum speed.

Also shown in FIG. 3 is a door panel 102 which is hinged at 104 and which when opened, provides access to the interior of the air plenum 64. It is through this opening that air filtering means, shown generally by numeral 106 can be inserted into and removed from the air plenum. The filter assembly 106 may preferably comprise, in the direction of air flow (arrow 107), a first stage filter 108 comprising a polyester matt capable of filtering out airborne particles greater in size than about 10 microns. The intermediate filter 110 may then comprise a HEPA (High Efficiency Particulate Air) filter formed from accordian-pleated paper and capable of removing airborne particles of a size down to approximately 0.3 microns. The third stage filter 112 comprises a bed of activated charcoal capable of substantially deodorizing the volume of air drawn through the filter assembly by the motor-driven fans 94 and 96.

From the foregoing description and drawings, then, it will be understood that when the trash compactor is standing idle, ready to be used, its doors 26 and 28 will be closed and the fans 94 and 96 will be running at their lowest speed. This will cause a continuous influx of air through the interface between the closed doors and the cabinet's side walls. Because of the location of the fans in the air plenum 64, that air will be drawn up through the three-stage filter, resulting in a removal of substantially all airborne particles down to submicron size as well as deodorization of the air before it is released out through the chute 98. When either of the doors 100 or 101 is opened, its associated switch 26 or 28 will be operated to shift the fan motors into their high-speed mode. This then will increase the amount of draft being drawn through the open doors to prevent contaminated airborne particles within the trash compactor to exit. Instead, they too will be drawn through the filter arrangement 106 and removed.

Ultimately, after a considerable period of use, the filters 108, 110 and 112 Will create an increased resistance to air flow due to buildup of contamination therein. Thus, the flow sensing switch 114 will be actuated to provide a visible or audible signal to an attendant who may then open the door panel 102 and remove the dirty filters for cleaning or replacement.

When it is desired to clean or sanitize the entire air plenum assembly, it may readily be removed from the compactor by lifting up on the panel 86 until the tabs 88 clear the slots 90, at which point the unit can be pulled free of the compactor's machine compartment and subjected to appropriate sanitation procedures.

This invention has been described herein in considerable detail in order to comply with the Patent Statutes and to provide those skilled in the art will the information need to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A method for compacting trash without the introduction of airborne contamination into the area surrounding the compacting apparatus comprising the steps of:

(a) providing a trash compacting apparatus including a cabinet in which is contained a reciprocally movable compaction plate and a first door through which trash to be compacted is introduced into said cabinet and a second door through which the compacted trash can be removed;

(b) creating a predetermined negative pressure within said cabinet effective to draw ambient air in through said first and second doors and to prevent the outflow of airborne contamination from said compacting apparatus; and (c) creating a negative pressure greater than said predetermined negative pressure when one of said first and second doors is opened.

2. The method as in claim 1 and further including the step of filtering the air stream created by said negative pressure.

* * * * *